US010483058B2

(12) United States Patent
Vaishnavi et al.

(10) Patent No.: US 10,483,058 B2
(45) Date of Patent: Nov. 19, 2019

(54) SAFETY SWITCH ACCESS ARRANGEMENT

(71) Applicant: Eaton Corporation, Cleveland, OH (US)

(72) Inventors: Romil Vaishnavi, Pune (IN); Chitra Dattaraya Nanaware, Pune (IN); Somnath Janaba Devarde, Dist. Kolhapur (IN)

(73) Assignee: Eaton Intelligent Power Limited, Dublin (IE)

( * ) Notice: Subject to any disclaimer, the term of this patent is extended or adjusted under 35 U.S.C. 154(b) by 3 days.

(21) Appl. No.: 15/602,582

(22) Filed: May 23, 2017

(65) Prior Publication Data

US 2018/0342359 A1 Nov. 29, 2018

(51) Int. Cl.
*H01H 19/24* (2006.01)
*H01H 11/00* (2006.01)

(52) U.S. Cl.
CPC ..... *H01H 19/24* (2013.01); *H01H 2011/0025* (2013.01)

(58) Field of Classification Search
CPC ..... H01H 9/06; H01H 19/24
USPC ..... 200/296, 330–332, 337, 50.03, 50.1, 200/50.12–50.14, 50.18
See application file for complete search history.

(56) References Cited

U.S. PATENT DOCUMENTS 4,168,407 A * 9/1979 Wiktor ..... H01H 21/20 200/18
4,612,424 A * 9/1986 Clark ..... H01H 9/22 200/330
5,493,084 A * 2/1996 Whitaker ..... H01H 3/10 200/50.05
2015/0364277 A1* 12/2015 Fischer ..... H02B 1/26 200/330

* cited by examiner

*Primary Examiner* — Ahmed M Saeed
*Assistant Examiner* — Lheiren Mae A Caroc
(74) *Attorney, Agent, or Firm* — Benesch Friedlander Coplan & Aronoff LLP (Eaton)

(57) ABSTRACT

An apparatus includes a circuit interrupting device installed in a cabinet. The circuit interrupting device has an actuator configured for rotation about a switching axis to switch the device between ON and OFF conditions. The apparatus further includes a front access hub supported for rotation about an axis orthogonal to the switching axis. A handle is coupled to the front access hub to rotate the front access hub about the orthogonal axis. A mechanism interconnects the front access hub with the actuator to rotate the actuator in response to rotation of the front access hub.

15 Claims, 3 Drawing Sheets

SAFETY SWITCH ACCESS ARRANGEMENT

TECHNICAL FIELD

This technology relates to a safety switch comprising a circuit interrupting device installed in a cabinet.

BACKGROUND

Safety switches are often used to act as a disconnect for commercial and industrial applications. The switch has to make and break the currents at the contacts safely to ensure electrical connection and disconnection of the circuit. Traditionally, an external handle is connected from side to the mechanism shaft and the energy to the mechanism is supplied manually. However, there is a need to have the switch operated from the front of the switch with a handle mounted on the door that would solve the issue of switch operation from side when there's a space constraint at customer's installation location as well as the switches can be integrated and sold with panel boards that require front operation.

SUMMARY

An apparatus includes a circuit interrupting device installed in a cabinet. The circuit interrupting device has an actuator configured for rotation about a switching axis to switch the device between ON and OFF conditions. The apparatus further includes a front access hub supported for rotation about an axis orthogonal to the switching axis. A handle is coupled to the front access hub to rotate the front access hub about the orthogonal axis. A mechanism interconnects the front access hub with the actuator to rotate the actuator in response to rotation of the front access hub.

The cabinet may have a door, and the handle may be coupled to the front access hub to rotate the front access hub about the orthogonal axis when the door is closed. In a given example, the door has an aperture, and the orthogonal axis is aligned with the aperture in the door when the door is closed. The handle is configured for releasable rotational coupling with the front access hub through the aperture in the door. In another given example, the actuator projects outward through a side panel of the cabinet, and the handle can remain coupled to the front access hub when the door is either open or closed.

The mechanism may include a linkage defining pivotal couplings between the front access hub and the actuator. In one such example, a linkage includes first, second, and third links. The first link is coupled to the front access hub to project radially from the orthogonal axis, and to move pivotally about the orthogonal axis upon rotation of the front access hub. The second link is coupled to the actuator to project radially from the actuator, and to rotate the actuator about the switching axis upon movement of the second link pivotally about the switching axis. The third link is coupled between the first and second links to transmit pivotal movement from the first link to the second link.

In alternative example, the mechanism includes gears defining a rotational coupling between the front access hub and the actuator. The gears include first and second bevel gears. The first bevel gear is coupled to the actuator to rotate the actuator about the switching axis. The second bevel meshes with first bevel gear, and is coupled to the front access hub to rotate about the orthogonal axis with the front access hub.

DETAILED DESCRIPTION

Figure 2:
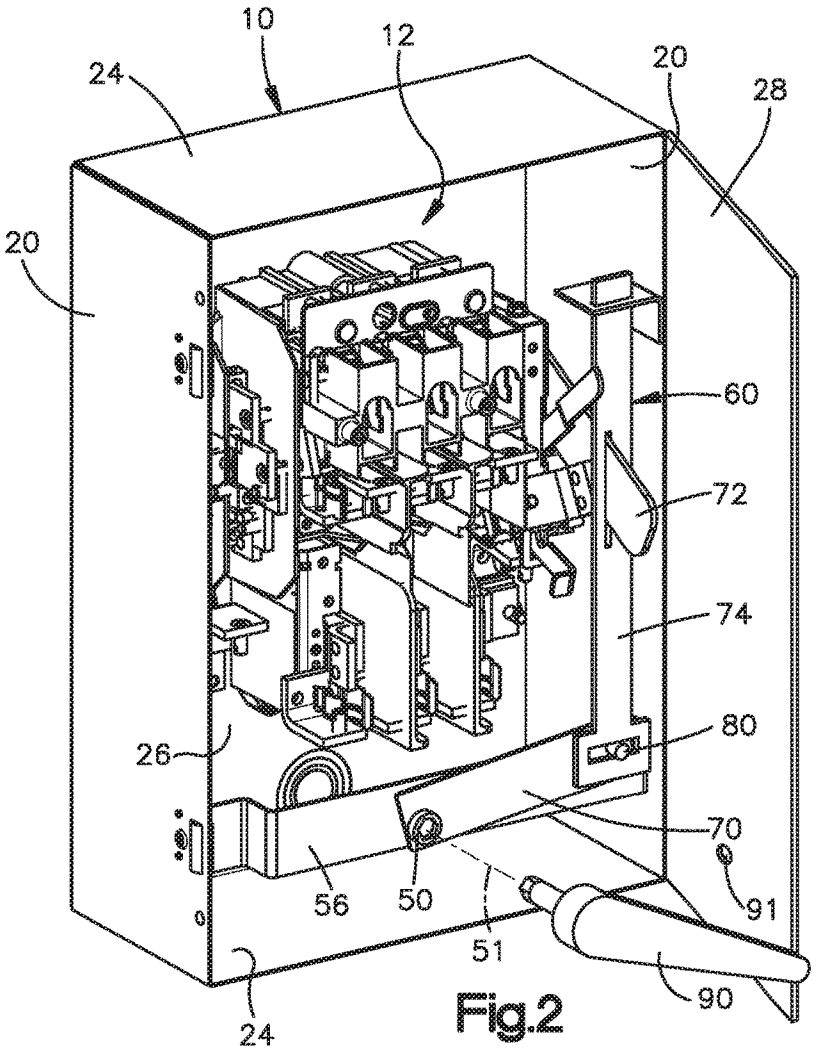
FIG. 2 is a view similar to FIG. 1, taken from a different angle.

The apparatus illustrated in the drawings includes parts that are examples of the elements recited in the claims. The illustrated apparatus thus includes examples of how a person of ordinary skill in the art can make and use the claimed invention. These examples are described to meet the enablement and best mode requirements of the patent statute without imposing limitations that are not recited in the claims.

Figure 1:
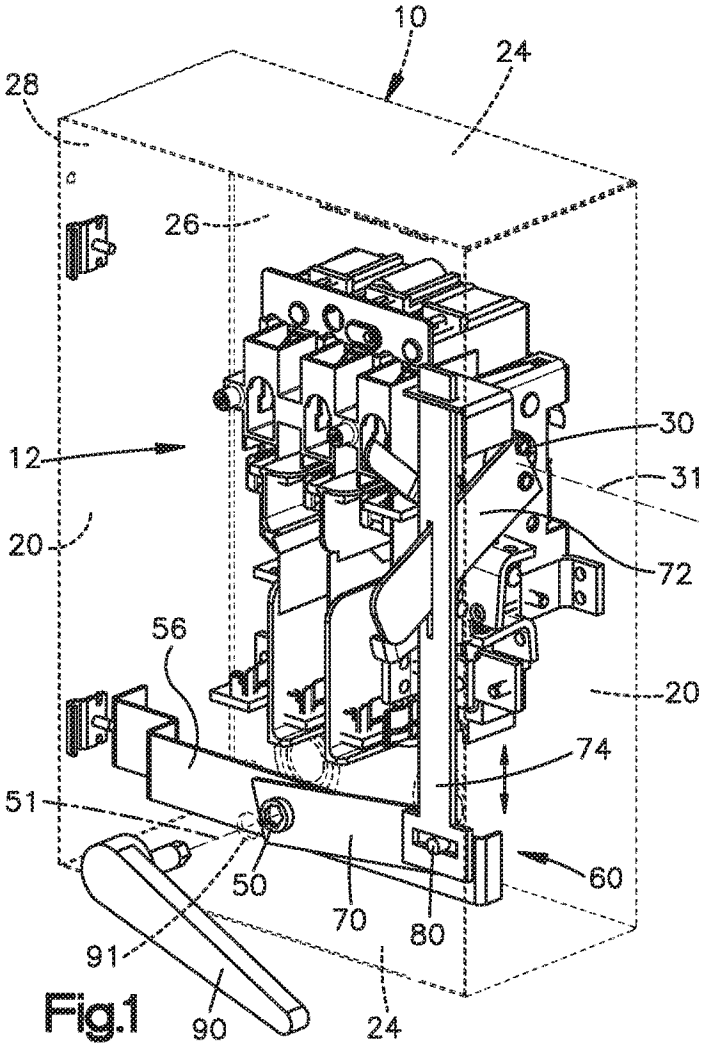
FIG. 1 is a front perspective view of an apparatus including a circuit interrupting device installed in a cabinet.

As shown in FIGS. 1 and 2, an electrical cabinet 10 contains a circuit interrupting device 12. The circuit interrupting device 12, which may be referred to as a safety switch, can be switched between an ON condition and an OFF condition. The cabinet 10 in the embodiment of FIG. 1 has opposite side panels 20, upper and lower end panels 24, a rear panel 26, and a front panel defined by a door 28.

The device 12 includes an actuator 30. The actuator 30 is supported for rotation about a switching axis 31, and is rotatable through a range of positons including an open position, a closed position, and an intermediate position. As known in the art, the device 12 also includes springs and contacts. The springs apply tension to resist movement of the actuator 30 out of the open and closed positons toward the intermediate position, and to snap the actuator 30 into either the open position or the closed position upon moving past the intermediate position. As the actuator 30 moves into the open position, it interacts with the contacts to switch the device 12 into the ON condition. As the actuator 30 moves into the closed position, it interacts with the contacts to switch the device 12 into the OFF condition.

As shown in FIG. 2, the switching axis 31 for the actuator 30 is oriented horizontally across the cabinet 10 between the opposite side panels 20. As further shown in FIG. 2, a front access hub 50 also is supported in the cabinet 10 for rotation about a respective axis 51. Specifically, the front access hub 50 is supported for rotation on a bracket 56 that is fixed to the cabinet 10. The bracket 56 supports the front access hub 50 such that the axis 51 is horizontal, but is oriented in a forward direction orthogonal to the horizontal switching axis 31 at the actuator 30.

A mechanism is provided to interconnect the front access hub 50 with the actuator 30 so as to transmit rotational movement from the front access hub 50 to the actuator 30. In the example shown in FIGS. 1-6, the mechanism is configured as a linkage 60. In this embodiment the linkage 60 includes first, second, and third links 70, 72 and 74 defining pivotal couplings between the front access hub 50 and the actuator 30.

The first link 70 is coupled to the front access hub 50 to project radially from the orthogonal axis 51, and to move pivotally about the orthogonal axis 51 upon rotation of the front access hub 50. A driving pin 80 projects forward from an outer end portion of the first link 70.

The second link 72 is coupled to the actuator 30 to project radially from the switching axis 31, and to rotate the actuator 30 about the switching axis 31 upon movement of the second link 72 pivotally about the switching axis 31.

The third link 74 is coupled between the first and second links 70 and 72 to transmit pivotal movement from the first link 70 to the second link 72. Specifically, the third link 74 is coupled between the first and second links 70 and 72 to reciprocate in opposite directions between the first and second links 70 and 72 upon movement of those links 70 and 72 pivotally about the axes 31 and 51. In the illustrated embodiment, the opposite directions are vertical, as indicated by the arrows shown in the drawings.

Figure 3:
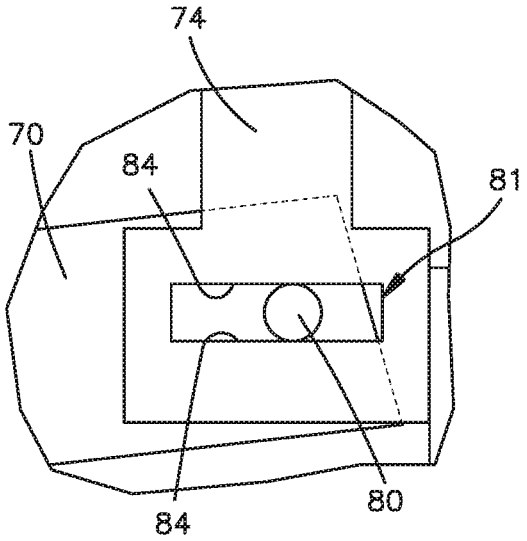
FIG. 3 is an enlarged partial view of parts shown in FIGS. 1 and 2.
Figure 4:
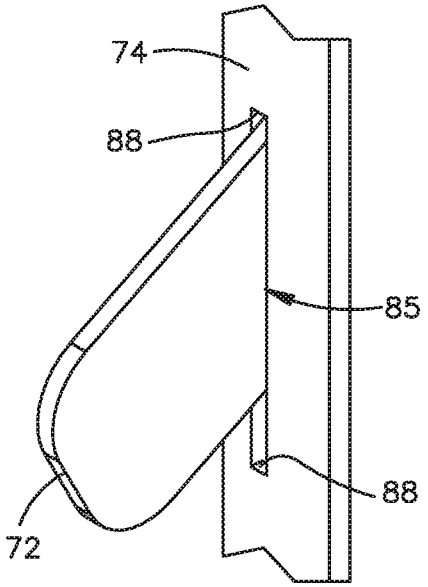
FIG. 4 is an enlarged partial view of other parts shown in FIGS. 1 and 2.

In the illustrated linkage 60, the third link 74 has a lower slot 81. The lower slot 81 is elongated horizontally with opposite sides 84 (FIG. 3). The driving pin 80 on the first link 70 projects though the lower slot 81, and is moveable against the opposite sides 84 of the lower slot 81 to move the third link 74 vertically upward or downward when the first link 70 is moved pivotally about the orthogonal axis 51.

The third link 74 further has an upper slot 85 that is elongated vertically with opposite ends 88 (FIG. 8). The second link 72 projects through the upper slot 85. When the third link 74 is moved vertically upward and downward, the opposite ends 88 of the upper slot 85 move against the second link 72 so as move the second link 72 pivotally about the switching axis 31, and thereby to rotate the actuator 30 about the switching axis 31.

A releasable handle 90 is provided for manually rotating the front access hub 50 about the orthogonal axis 51. As shown in FIGS. 1 and 2, the door 28 has an aperture 91. As shown in the sectional view of FIG. 5, the orthogonal axis 51 is aligned with the aperture 91 when the door 28 is closed. The handle 90 is configured for releasable rotational coupling with the front access hub 50 through the aperture 91 when the door 28 closed.

Figure 5:
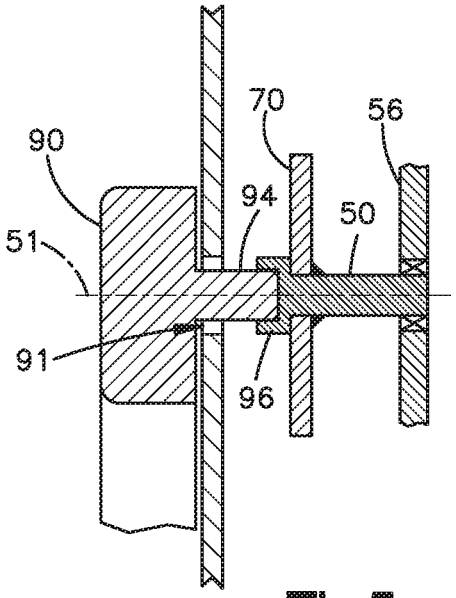
FIG. 5 is an enlarged sectional view of parts shown in FIGS. 1 and 2.
Figure 6:
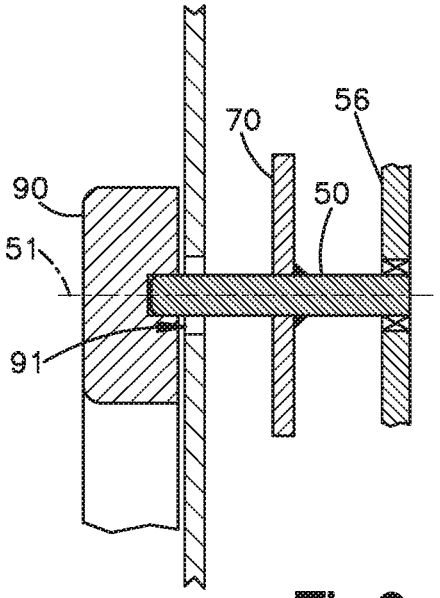
FIG. 6 is a sectional view similar to FIG. 5, showing an alternative embodiment of such parts.

As further shown in FIG. 5, the handle 90 has an extension 94 configured to project inward through the aperture 91 in the door 28 for coupling with the front access hub 50 in a socket portion 96 of the front access hub 50. In the embodiment of FIG. 6, the front access hub 50 is configured to project outward through the aperture 91 in the door 28 for coupling with the handle 90 in a similar manner. In each case, the user can couple the handle 90 with the front access hub 50 through the aperture 91, and can move the handle 90 pivotally about the orthogonal axis 57 to operate the linkage 60 for switching the circuit interrupting device 12 between the ON and OFF conditions, without the need to reach to stand or reach at the side of the cabinet 10.

Figure 7:
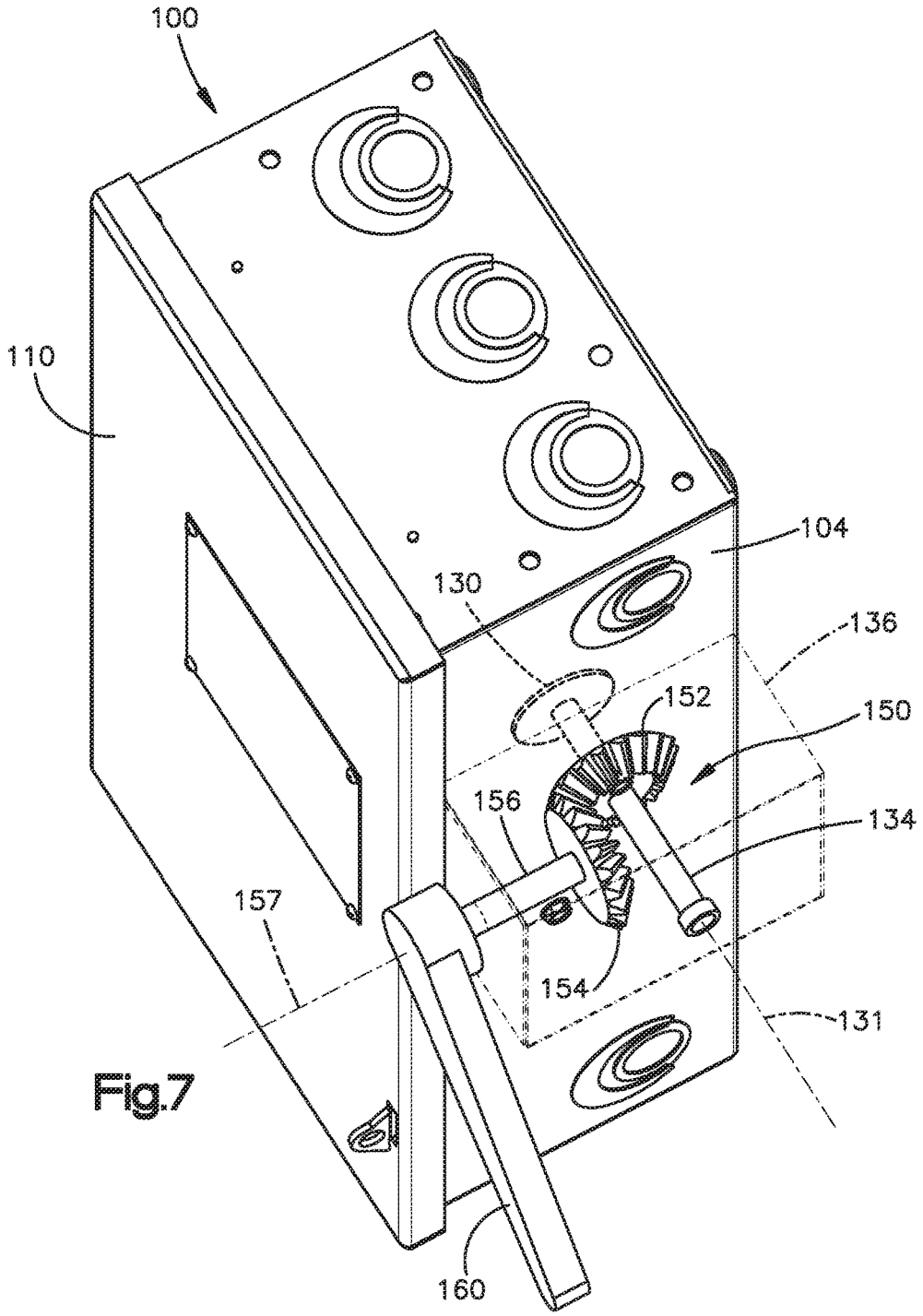
FIG. 7 is a front perspective view of an another alternative embodiment.

An additional embodiment is shown in FIG. 7. This embodiment also includes a circuit interrupting device installed in a cabinet 100. Like the cabinet 10 described above, the cabinet 100 has opposite side panels 104 and a front panel defined by a door 110. The circuit interrupting device has an actuator 130 supported for rotation about a switching axis 131 oriented horizontally across the cabinet 100 between the opposite side panels 104. A shaft 134 on the actuator 130 projects axially outward through the adjacent side panel 104 and into a side compartment 136 of the cabinet 100.

A mechanism 150 is arranged within the side compartment 136. The mechanism 150 includes a first bevel gear 152 mounted on the shaft 134 to rotate the shaft 134 and the actuator 130 about the switching axis 131. The mechanism 150 further includes a second bevel gear 154 in meshing engagement with the first bevel gear 152. The second bevel gear 154 is mounted on a front access hub 156 to rotate about an axis 157 with the front access hub 156. That axis 157 is horizontal, but is oriented in a forward direction orthogonal to the horizontal switching axis 131 at the actuator 130.

The front access hub 156 projects outward through a front panel 158 of the side compartment 136. A manual handle 160 is mounted on the front access hub 56 and projects radially from the axis 157. A user can move the handle 160 pivotally to rotate the front access hub 156, and thereby operate the linkage 150 for switching the circuit interrupting device ON and OFF. This can be performed whether the door 110 is open or closed, and without the need to stand or reach at the side of the cabinet 100.

This written description sets for the best mode of carrying out the invention, and describes the invention so as to enable a person of ordinary skill in the art to make and use the invention, by presenting examples of the elements recited in the claims. The detailed descriptions of those examples do not impose limitations that are not recited in the claims, either literally or under the doctrine of equivalents.

What is claimed is:

1. An apparatus comprising:

a cabinet;

a circuit interrupting device installed in the cabinet, the circuit interrupting device having an actuator configured for rotation about a switching axis to switch the circuit interrupting device between ON and OFF conditions;

a front access hub supported for rotation about an axis orthogonal to the switching axis;

a handle coupled to the front access hub to rotate the front access hub about the orthogonal axis;

a first link coupled to the front access hub to project radially from the orthogonal axis, and to move pivotally about the orthogonal axis upon rotation of the front access hub;

a second link coupled to the actuator to project radially from the actuator, and to rotate the actuator about the switching axis upon movement of the second link pivotally about the switching axis; and a third link coupled between the first and second links to transmit pivotal movement between the first and second links;

wherein the third link is coupled between the first and second links to move in opposite directions between the first and second links upon movement of the first and second links pivotally about the orthogonal axis and the switching axis; and the third link has a first elongated slot with opposite ends, the second link projects through the first elongated slot, and the opposite ends of the first elongated slot are movable against the second link to move the second link pivotally about the switching axis.

2. An apparatus as defined in claim 1, wherein the third link has a second elongated slot with opposite sides, the first link has a driving portion projecting though the second elongated slot, and the driving portion of the first link is movable against the opposite sides of the second elongated slot to move the third link in the opposite directions.

3. An apparatus as defined in claim 1, wherein the switching axis and the orthogonal axis are horizontal, and the opposite directions are vertical.

4. An apparatus as defined in claim 1, further comprising a handle coupled to the front access hub to rotate the front access hub about the orthogonal axis, wherein the cabinet has a door, and the handle is configured for coupling with the front access hub when the door is closed so as to rotate the front access hub about the orthogonal axis when the door is closed.

5. An apparatus as defined in claim 4, wherein the door has an aperture, the orthogonal axis is aligned with the aperture in the door when the door is closed, and the handle is configured for releasable rotational coupling with the front access hub through the aperture in the door when the door is closed.

6. An apparatus as defined in claim 5, wherein the front access hub is configured to project outward through the aperture in the door for coupling with the handle when the door is closed.

7. An apparatus comprising:

a cabinet;

a circuit interrupting device installed in the cabinet, the circuit interrupting device having an actuator configured for rotation about a switching axis to switch the circuit interrupting device between ON and OFF conditions;

a front access hub supported for rotation about an axis orthogonal to the switching axis; and a linkage configured to transmit rotational movement from the front access hub to the actuator, including a reciprocating link supported for reciprocating movement in opposite directions, and a pivotal link supported for movement pivotally relative to the reciprocating link;

wherein the reciprocating link has an elongated slot with opposite ends, the pivotal link projects through the elongated slot, and the opposite ends of the slot are movable against the pivotal link to move the pivotal link pivotally relative to the reciprocating link; and the pivotal link is coupled to the actuator to project radially from the actuator, and to rotate the actuator about the switching axis upon movement of the pivotal link pivotally about the switching axis.

8. An apparatus as defined in claim 7, further comprising a handle coupled to the front access hub to rotate the front access hub about the orthogonal axis, wherein the cabinet has a door, and the handle is configured for coupling with the front access hub when the door is closed so as to rotate the front access hub about the orthogonal axis when the door is closed.

9. An apparatus as defined in claim 8, wherein the door has an aperture, the orthogonal axis is aligned with the aperture in the door when the door is closed, and the handle is configured for releasable rotational coupling with the front access hub through the aperture in the door when the door is closed.

10. An apparatus as defined in claim 9, wherein the front access hub is configured to project outward through the aperture in the door for coupling with the handle when the door is closed.

11. An apparatus comprising:

a cabinet;

a circuit interrupting device installed in the cabinet, the circuit interrupting device having an actuator configured for rotation about a switching axis to switch the circuit interrupting device between ON and OFF conditions;

a front access hub supported for rotation about an axis orthogonal to the switching axis;

a linkage configured to transmit rotational movement from the front access hub to the actuator, including a reciprocating link supported for reciprocating movement in opposite directions, and a pivotal link supported for movement pivotally relative to the reciprocating link;

wherein the reciprocating link has a first elongated slot with opposite ends, the pivotal link projects through the first elongated slot, and the opposite ends of the first elongated slot are movable against the pivotal link to move the pivotal link pivotally relative to the reciprocating link; and an additional pivotal link, wherein the reciprocating link has a second elongated slot with opposite sides, and the additional pivotal link has a driving portion projecting through the second elongated slot, and the driving portion is movable against the opposite sides of the second elongated slot to move the reciprocating link in the opposite directions.

12. An apparatus as defined in claim 11, wherein the additional pivotal link is coupled to the front access hub to project radially from the orthogonal axis, and to move pivotally about the orthogonal axis upon rotation of the front access hub.

13. An apparatus as defined in claim 11, further comprising a handle coupled to the front access hub to rotate the front access hub about the orthogonal axis, wherein the cabinet has a door, and the handle is configured for coupling with the front access hub when the door is closed so as to rotate the front access hub about the orthogonal axis when the door is closed.

14. An apparatus as defined in claim 13, wherein the door has an aperture, the orthogonal axis is aligned with the aperture in the door when the door is closed, and the handle is configured for releasable rotational coupling with the front access hub through the aperture in the door when the door is closed.

15. An apparatus as defined in claim 14, wherein the front access hub is configured to project outward through the aperture in the door for coupling with the handle when the door is closed.

* * * * *